US010464132B2

(12) United States Patent
Sakuma et al.

(10) Patent No.: US 10,464,132 B2
(45) Date of Patent: Nov. 5, 2019

(54) PERMANENT MAGNET SOURCE POWDER FABRICATION METHOD, PERMANENT MAGNET FABRICATION METHOD, AND PERMANENT MAGNET RAW MATERIAL POWDER INSPECTION METHOD

(71) Applicants: Noritsugu Sakuma, Susono (JP); Hidefumi Kishimoto, Susono (JP); Mikiya Nozaki, Toyota (JP); Masao Yano, Susono (JP); Tetsuya Shoji, Toyota (JP); Akira Manabe, Toyota (JP)

(72) Inventors: Noritsugu Sakuma, Susono (JP); Hidefumi Kishimoto, Susono (JP); Mikiya Nozaki, Toyota (JP); Masao Yano, Susono (JP); Tetsuya Shoji, Toyota (JP); Akira Manabe, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 208 days.

(21) Appl. No.: 14/773,571

(22) PCT Filed: May 24, 2013

(86) PCT No.: PCT/JP2013/064519

§ 371 (c)(1),
(2) Date: Sep. 8, 2015

(87) PCT Pub. No.: WO2014/188596

PCT Pub. Date: Nov. 27, 2014

(65) Prior Publication Data

US 2016/0074936 A1 Mar. 17, 2016

(51) Int. Cl.

| | |
|---|---|
| ***B22F 3/10*** | (2006.01) |
| ***B22F 3/14*** | (2006.01) |
| ***C21D 1/56*** | (2006.01) |

(Continued)

(52) U.S. Cl.

CPC ..... *B22F 3/1017* (2013.01); *B22F 3/14* (2013.01); *C21D 1/56* (2013.01); *C22C 28/00* (2013.01);

(Continued)

(58) Field of Classification Search

None

See application file for complete search history.

(56) References Cited

U.S. PATENT DOCUMENTS 4,785,239 A * 11/1988 Brunsch ..... G01N 27/74 324/204
4,981,532 A * 1/1991 Takeshita ..... B22F 9/023 148/302

(Continued)

FOREIGN PATENT DOCUMENTS

EP 1168380 A1 1/2002
EP 1338359 A1 8/2003

(Continued)

OTHER PUBLICATIONS

Machine translation of JP-09275004-A, generated Apr. 12, 2018 (Year: 2018).*

*Primary Examiner* — Colleen P Dunn
*Assistant Examiner* — Anthony M Liang
(74) *Attorney, Agent, or Firm* — Oliff PLC

(57) ABSTRACT

A method for producing a raw material powder of a permanent magnet, includes: preparing a material powder of a permanent magnet, measuring magnetic characteristics of the material powder, and judging the quality of the material powder as the raw material powder based on a preliminarily determined relation between magnetic characteristics and the structure of the material powder. A method for producing a permanent magnet includes integrating material powders judged as good in the step of judging the quality as raw material powders by the method for producing a raw mate- (Continued)

rial powder of a permanent magnet. A method for inspecting a permanent magnet material powder includes transmitting a magnetic field to a material powder of a permanent magnet, receiving the magnetic field from the material powder, and measuring a magnetic field difference between the transmitted magnetic field and the received magnetic field as magnetic characteristics of the material powder.

22 Claims, 6 Drawing Sheets

(51) Int. Cl.
*H01F 1/06* (2006.01)
*H01F 1/057* (2006.01)
*C22C 28/00* (2006.01)
*H01F 41/02* (2006.01)

(52) U.S. Cl.
CPC ..... *H01F 41/0266* (2013.01); *H01F 1/0577* (2013.01)

(56) References Cited

U.S. PATENT DOCUMENTS

| | | | | |
|---|---|---|---|---|
| 2003/0183305 | A1 | 10/2003 | Murakami et al. | |
| 2006/0081308 | A1* | 4/2006 | Murakami | B22D 11/0611 148/100 |
| 2014/0260800 | A1* | 9/2014 | Sakuma | H01F 1/0571 75/347 |

FOREIGN PATENT DOCUMENTS

| | | | | |
|---|---|---|---|---|
| JP | 09275004 | A * | 10/1997 | H01F 1/0576 |
| JP | 2000-046801 | A | 2/2000 | |
| JP | 2003-194958 | A | 7/2003 | |
| JP | 2008-058054 | A | 3/2008 | |
| JP | 2013-084804 | A | 5/2013 | |
| WO | 02/30595 | A1 | 4/2002 | |

* cited by examiner

PERMANENT MAGNET SOURCE POWDER FABRICATION METHOD, PERMANENT MAGNET FABRICATION METHOD, AND PERMANENT MAGNET RAW MATERIAL POWDER INSPECTION METHOD

TECHNICAL FIELD

The present invention relates to a method for producing a permanent magnet raw material powder using a powder as a material, a method for producing a permanent magnet, and a magnetic inspection method of a permanent magnet material powder.

BACKGROUND ART

There is a need for a permanent magnet to have large magnetic flux density and coercivity. Particularly, a rare earth magnet typified by a neodymium magnet ($Nd_2Fe_{14}B$) is used in various applications as an extremely strong permanent magnet because of its high magnetic flux density.

In a typical method for producing a permanent magnet, in order to obtain high magnetic flux density after sintering a raw material powder of the permanent magnet, crystal grains are rotated by intensive hot-working of a sintered body to form a texture composed of crystal grains oriented in the direction of an axis of easy magnetization (Patent Literature 1).

If the raw material powder has a structure composed of numerous coarse grains (typically, coarse crystal grains each having a crystal grain diameter of more than 300 nm) (coarse grain structure), coarse grains are less likely to rotate in the case of intensive work and thus the degree of orientation decreases, leading to reduction in residual magnetization. Coercivity also decreases due to coarse grains.

If the raw material powder has a structure composed of numerous amorphous, it is impossible to obtain an oriented structure that is made for a crystalline material to do, leading to a reduction in residual magnetization.

Accordingly, in order to ensure high degree of orientation by intensive hot-working to obtain large residual magnetization, it is important that the structure of the raw material powder is a nanocrystalline structure (typically having a crystal grain diameter of about 30 to 50 nm), which is neither a coarse grain structure nor an amorphous structure.

Therefore, there is a need to inspect the proportions of coarse grains or amorphous structures included in the raw material powder (coarse grain ratio or amorphous structure ratio).

In order to directly observe the structure of the raw material powder, a powder grain must be observed by TEM, SEM, or the like. However, it is difficult to apply the inspection of a coarse grain ratio or an amorphous structure ratio of the raw material powder by these methods of observing individual powder grains to actual industrial production.

CITATION LIST

Patent Literature

Patent Literature 1
Japanese Patent Application No. 2011-224115

SUMMARY OF INVENTION

Technical Problem

With respect to powder referred to normally as "raw material powder" of a permanent magnet in the past, hereinafter, a state prior to the application of the method of the present invention is referred to as "material powder" while a state subsequent to the application of the method of the present invention is referred to as "raw material powder", and both are conveniently distinguished.

An object of the present invention is to provide a method for producing a raw material powder suited for the production of a permanent magnet having high residual magnetization and coercivity by quickly inspecting the propriety of the structure of a material powder in actual industrial production; a method for producing a permanent magnet; and a method for inspecting a permanent magnet material powder.

Solution to Problem

To achieve the above object, the method for producing a permanent magnet raw material powder of the present invention is a method for producing a raw material powder of a permanent magnet, which includes the steps of:

preparing a material powder of a permanent magnet, measuring magnetic characteristics of the material powder of the permanent magnet, and judging the quality of the material powder as the raw material powder based on a preliminarily determined relation between magnetic characteristics and the structure of the material powder.

The method for inspecting a permanent magnet powder of the present invention includes transmitting a magnetic field to a material powder of a permanent magnet, receiving the magnetic field from the material powder, and measuring a magnetic field difference between the transmitted magnetic field and the received magnetic field as magnetic characteristics of the material powder.

Advantageous Effects of Invention

According to the method for producing a permanent magnet raw material powder of the present invention, it is possible to employ, as raw material powders, only material powders which have passed a magnetic inspection of the structure of the material powder, thus enabling the production of a permanent magnet certain to have high residual magnetization and coercivity. According to the method for inspecting a permanent magnet raw material powder of the present invention, it is possible to quickly inspect magnetic characteristics of a material powder in the production process of a permanent magnet raw material powder, thus enabling the application to the actual industrial production with ease.

DESCRIPTION OF EMBODIMENTS

Figure 1:
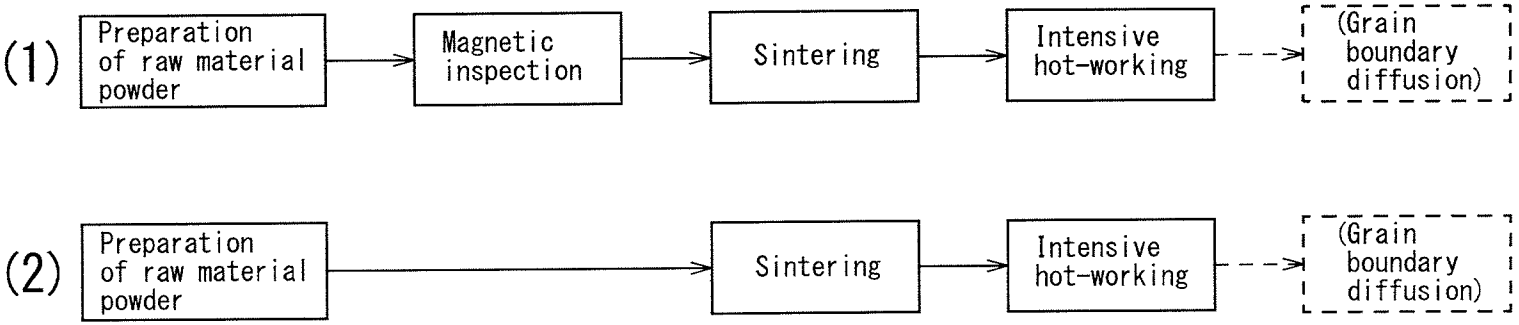
FIG. 1 is a flow chart showing a typical example of the production process of a permanent magnet by (1) a method of the present invention and (2) a conventional method while making a comparison between these methods.

A description will be made on the case where raw material powders are integrated by sintering and then subjected to hot working, as a typical mode of the present invention.

According to the present invention, the proportions of structural components (nanocrystalline component, coarse grain component, amorphous component) of the material powder are inspected from a magnetization curve when a material powder of a permanent magnet is magnetized within a range capable of being recovered in a weak magnetic field, and then only a material powder, which has sufficiently high content of a nanocrystalline component and also has a structure capable of obtaining a high degree of orientation by hot working, is used as a raw material powder, and is transferred to the subsequent step including sintering and hot working. This quality judgment is carried out per material powder lot.

In the present invention, structural components are defined as follows.

Nanocrystalline structure: that refers to a structure including crystal grains each having a diameter of 5 to 4 nm in the broad sense, and refers to a structure including crystal grains each having a diameter of 10 to 100 nm in the narrow sense.

Coarse grain structure: that refers to a structure including grains each having a diameter more than that of a crystal grain of nanocrystal. The diameter of a coarse grain is more than 100 nm in the narrow sense, and is more than 400 nm in the broad sense.

Amorphous structure: that is generally an amorphous structure, and is a structure which also includes the case of an ultrafine crystal structure including crystal grains each having a diameter of 5 nm or less in the broad sense and having a diameter of 1 nm or less in the narrow sense, and which cannot exhibit coercivity (structure in which a clear diffraction peak cannot be observed in X-ray diffraction), particularly in a permanent magnet.

A liquid quenching method is typically used as a method for obtaining a nanocrystalline structure. It is also possible to obtain a nanocrystalline structure by the HDDR (hydrogenation/decomposition+desorption/recombination) method. However, the liquid quenching method is a leading method as a method for producing a material powder on an industrial scale, and also has high versatility.

The liquid quenching method is capable of continuously producing a quenched flake by bringing a molten magnetic alloy into contact with a surface of a rotary cooling roll. The quenched flake can be used as a material powder of a permanent magnet as it is or after pulverizing optionally.

In liquid quenching, the quenched flake has a structure composed of nanocrystal grains each having a grain diameter of about 30 to 50 nm within a certain range of a given cooling rate. If the cooling rate is lower than the above range, coarse grains each having a crystal grain diameter of more than 300 nm are formed. Meanwhile, if the cooling rate is higher than the above range, an amorphous structure is formed.

Basically, there is a need to control the cooling rate during quenching within a proper range. However, the formation process of the quenched flake by liquid quenching is a phenomenon in which the process of bringing the molten metal discharged through a nozzle into contact with a roll surface to thereby solidify on the roll surface to form a quenched flake, followed by separation of the quenched flake from the roll surface occurs instantly. Therefore, it is difficult to stably maintain the cooling rate within the proper range over the entire one heat of the molten metal. As a result, in addition to a structure composed only of proper nanocrystal, a structure including coarse grains and/or an amorphous structure coexisting therein is sometimes formed. Particularly, it is sometimes difficult to control the cooling rate at the time of starting and completion of discharging of the molten metal.

Therefore, in the method of the present invention, a distinction will be made on a powder lot, which has a high content of a nanocrystalline component and is also expected to obtain high residual magnetization and coercivity, by indirectly inspecting the proportions of structural components of a material powder (quenched flake) in a state where structural components coexist through magnetic characteristics in actual industrial production.

A flow chart showing a typical example of the production process of a permanent magnet by (1) a method of the present invention and (2) a conventional method while making a comparison between these methods is shown in FIG. 1.

<Preparation of Material Powder>

First, as shown in the left end, a material powder of a permanent magnet is prepared. Desirably, the material powder used in the present invention obtained by a liquid quenching method, an HDDR method, and the like has an internal structure composed of a nanocrystalline structure including crystal grains each having a nanosize crystal grain diameter, desirably a crystal grain diameter of about 100 nm or less, and more desirably about 30 to 50 nm. There is no need to particularly limit the composition of the permanent magnet, and the composition is desirably the composition of a rare earth magnet such as NdFeB, SmCo, or SmFeN which are excellent in magnetic characteristics.

In order to obtain the nanocrystalline structure by the liquid quenching method, the cooling rate is adjusted within a range of about $10^5$ K/s to $10^7$ K/s. If the cooling rate is lower than this proper range, coarse grain (each having a crystal grain diameter of about 300 nm or more) are formed. Meanwhile, if the cooling rate is higher than the above range, an amorphous structure is formed.

The material powder (quenched flake) can be optionally pulverized. In a state where a quenched flake is formed, the quenched flake has a thickness of about several tens of μm, a width of about 1 μm to 2 μm, and a length of about 50 μm to 1,000 μm. This quenched flake is pulverized to desirably obtain a pulverized flake having a length of 200 μm to 300 μm, and more desirably about 10 μm to 20 μm. The pulverizing method is desirably carried out using an apparatus capable of pulverizing at low energy, such as a mortar, a cutter mill, a pot mill, a jaw crusher, a jet mill, or a roll mill. When using a pulverizer rotating at high speed, such as a ball mill or a beads mill, working strain is drastically introduced into the material powder, leading to deterioration of magnetic characteristics.

<Magnetic Inspection>

Next, the material powder thus prepared above is subjected to magnetic inspection which is a feature of the present invention to thereby measure the proportions of structural components of an internal structure (i.e., a nanocrystal grain component, a coarse grain component, or an amorphous component) and then the quality is determined by the proportion of the coarse grain component or amorphous component which is an undesirable structural component (a coarse grain ratio or an amorphous ratio). As described hereinafter, quality determination is carried out every production lot of the material powder, thus making it possible to ensure a high proportion of the nanocrystal grain component. As shown in FIG. 1(2), this magnetic inspection was not carried out heretofore. Except for the presence or absence of magnetic inspection, the production step is common to the method of the present invention and a conventional method. Details of the magnetic inspection will be described hereinafter.

<Sintering>

Next, according to the method of the present invention (1), only material powders passing the magnetic inspection are integrated by sintering as raw material powders. According to a conventional method (2), material powders were sintered without being subjected to magnetic inspection.

The sintering temperature is adjusted to comparatively low temperature of about 550 to 700° C. so as to suppress coarsening.

The pressure during sintering is adjusted to comparatively high pressure of about 40 to 500 MPa so as to suppress coarsening.

The retention time at the sintering temperature is adjusted within 60 minutes so as to suppress coarsening.

The sintering atmosphere is an inactive atmosphere (non-oxidizing atmosphere) so as to suppress coarsening.

<Intensive Hot-Working>

Next, according to the present invention, only material powders passing magnetic inspection are subjected to intensive hot-working as raw material powders. Whereby, nanocrystal grains easily rotate during hot working to form a texture having a high degree of orientation to an axis of easy magnetization, thus obtaining high residual magnetization. At the same time, high coercivity due to fine nanocrystal grains composed of single magnetic domains is also ensured.

Intensive hot-working enables plastic deformation, but is carried out at a temperature, at which coarsening of crystal grains is less likely to occur, by enough intensive work to obtain a high degree of orientation to an axis of easy magnetization as a result of rotation of crystals. For example, in the case of a neodymium magnet, intensive hot-working is carried out at a working temperature of about 600 to 800° C.

The strain rate of intensive hot-working is adjusted to about 0.01 to 30/s and working is completed within as short a time as possible so as to suppress coarsening.

The intensive hot-working atmosphere is an inactive atmosphere (non-oxidizing atmosphere) so as to suppress coarsening.

<Grain Boundary Diffusion (Optional)>

Finally, desirably, a low melting point metal (alloy) is diffused into grain boundaries. For example, in the case of a neodymium magnet ($Nd_2Fe_{14}B$), a low melting point alloy such as Nd—Cu is diffused into grain boundaries by impregnation to thereby accelerate division between crystal grains, leading to further enhancement in coercivity.

Figure 2:
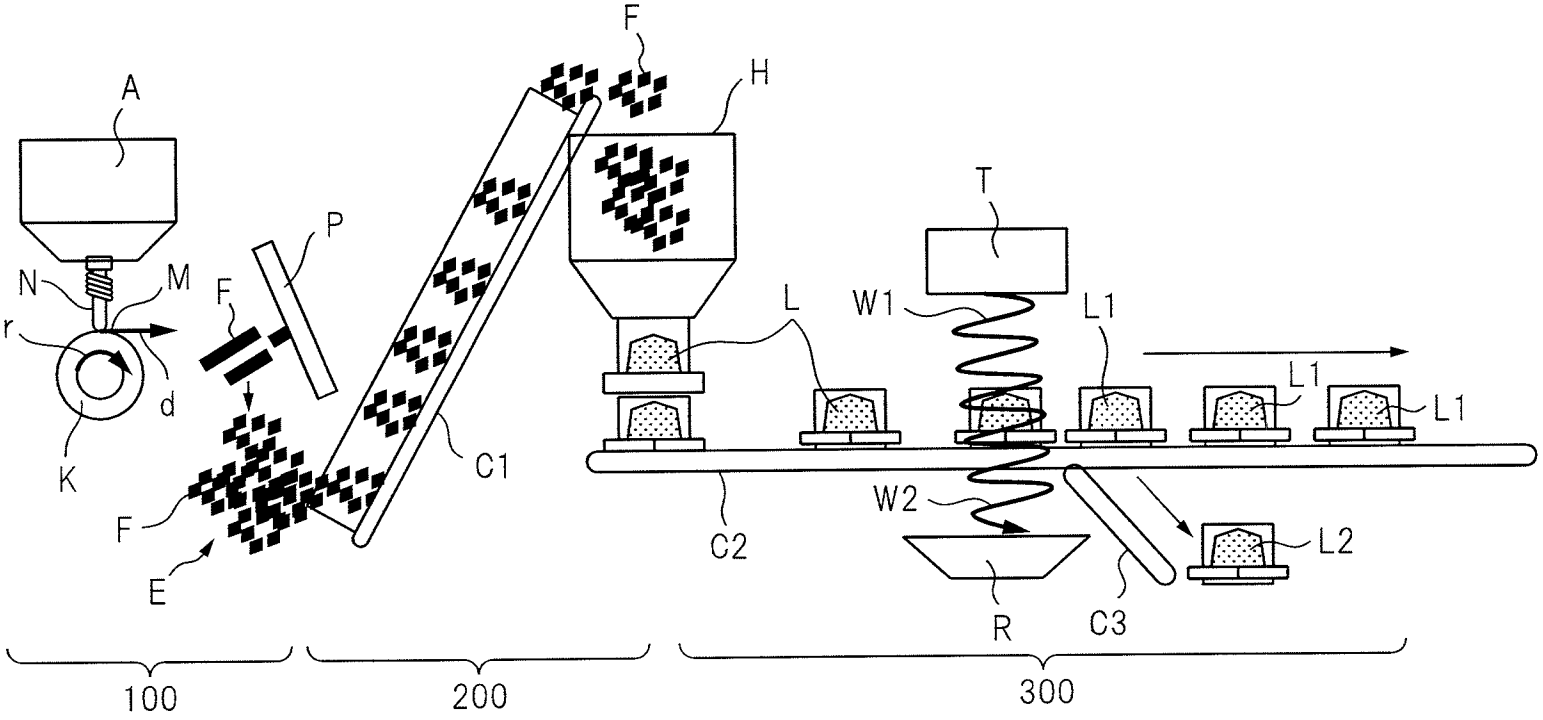
FIG. 2 schematically showing an example of applying inspection of magnetic characteristics of the present invention to a material powder (quenched flake) produced by a liquid quenching method.

An example of applying inspection of magnetic characteristics of the present invention to a material powder (quenched flake) produced by a liquid quenching method is schematically shown in FIG. 2. A liquid quenching step 100, a conveyance step 200, and a magnetic inspection step 300 are arranged from the left.

In the liquid quenching step 100, quenched flakes as material powders are produced. A molten metal M of a permanent magnet alloy discharged through a nozzle N from a mortar A is fed on a roll surface of a cooling roll K rotating in the direction of the arrow r and solidified on the roll surface, and then quenched flakes F thus formed are separated from the roll surface, jump out in the direction of the arrow d (in the tangential direction of the roll surface), are crushed due to colliding against a cooling plate P, and then recovered as a material powder E. The material powder E is optionally pulverized.

The material powder E is conveyed by a belt conveyor C1 in the conveyance step 200, and then placed on a belt conveyor C2 through a hopper H every production lot L.

In the magnetic inspection step 300, the material powder E is conveyed on the belt conveyor C2 every production lot L unit. A transmitter T of a magnetic field for inspection, and a receiver R are disposed at opposite positions across the belt conveyor C2. A transmitted magnetic field W1 from the transmitter T moves along the belt conveyor C2 and passes through the production lot L passing through the space between the transmitter T and receiver R. At this time, the magnetic field changes into a transmitted magnetic field W2 reflecting magnetic characteristics of structural components of the material powder E of the production lot L, which is then received by the receiver R.

The magnetic field applied to the material powder in the magnetic inspection may be either a magnetostatic field or an alternating magnetic field. The alternating magnetic field has an advantage that the magnetic field is repeatedly applied and thus a difference between the transmitted magnetic field W1 and the transmitted magnetic field W2 is integrated to thereby increase the magnetic field, leading to enhancement in sensitivity.

The intensity of the magnetic field applied for inspection is adjusted to a low intensity of about 0.5 mT to 100 mT (0.005 kOe to 1 kOe) so as to prevent magnetization of the material powder or to ensure signal intensity. The lower limit of the intensity of the magnetic field is desirably 5 mT from the viewpoint of ensuring signal intensity, and desirably 0.5 mT from the viewpoint of avoiding magnetization of the material powder. The lower limit of the intensity of the magnetic field is desirably 100 mT from the viewpoint of ensuring signal intensity, and desirably 50 mT from the viewpoint of avoiding magnetization of the material powder.

A difference between the transmitted magnetic field W1 transmitted from the transmitter T and the transmitted magnetic field W2 received by the receiver R is outputted as a peak intensity with a lapse of time by a signal processing apparatus (not shown). This peak intensity corresponds to the proportions of structural components (a nanocrystalline component, a coarse grain component, an amorphous component) in one production lot L of the material powder E which is an aggregate of a crushed (optionally further pulverized) quenched flake F.

Figure 3:
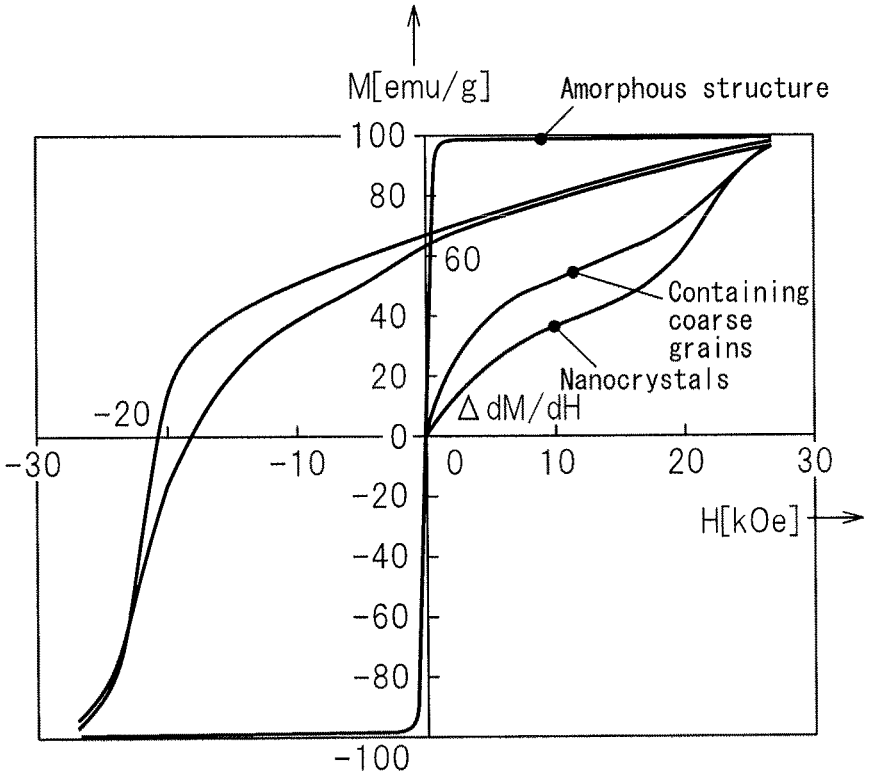
FIG. 3 shows a change in magnetization M (magnetization curve) when a magnetostatic field H is applied to material powders of various structural components (thermal demagnetization state).

A change in magnetization M (magnetization curve) when a magnetostatic field H is applied to material powders of various structural components (thermal demagnetization state) is shown in FIG. 3. As a material powder, NdFeB permanent magnet alloy was used as a sample.

In the drawing, attention is paid to a gradient dM/dH (initial magnetization gradient) of the rising section of a magnetization curve to which the magnetic field H is applied from the origin in which an applied magnetic field H=0, magnetization M=0 (initial magnetization curve section).

When the material powder is composed of 100% nanocrystals, a nanocrystal magnet is an aggregate of single magnetic domain grains. In the case of applying a magnetic field from a thermal demagnetization state, a magnetic domain wall makes little movement, leading to little magnetization and a low initial magnetization gradient dM/dH.

Meanwhile, in the material powder including 100% nanocrystals and coarse grains coexisting therein, coarse grains are multi-magnetic domain grains and thus a magnetic domain wall is likely to make movement, leading to an increase in initial magnetization gradient dM/dH in accordance with a mixed ratio of coarse grains.

Furthermore, when the material powder is composed of a 100% amorphous structure, the magnetic domain wall is more likely to make movement in the amorphous structure than coarse grains, leading to a significant increase in the initial magnetization gradient dM/dH.

Therefore, the initial magnetization gradient dM/dH varies depending on the existing proportion of structural components.

Use of this fact enables quality judgment of the material powder based on a coarse grain ratio or an amorphous structure ratio, or based on an initial magnetization gradient dM/dH.

Generally, the internal structure of the quenched flake formed by liquid quenching is composed of 100% nanocrystals when the cooling rate is within a proper range. When the cooling rate is lower than the proper range, coarse grains coexist with nanocrystals or the internal structure is composed of 100% coarse grains. Meanwhile, when the cooling rate is too high, an amorphous structure coexists with nanocrystals or the internal structure is composed of a 100% amorphous structure. In the order of increasing the cooling rate, the internal structure is composed as follows: [100% coarse grains]→[nanocrystals+coarse grains]→[100% nanocrystals]→[nanocrystals+amorphous structure]→[100% amorphous structure]. With respect to a 100% nanocrystal structure, it is only necessary to consider cases where coarse grains are formed due to an insufficient cooling rate and cases where an amorphous structure is formed due to an excessive cooling rate. Since the deficiency or excess of the cooling rate to the proper range can be judged by the actual measurement during liquid quenching, when the initial magnetization gradient dM/dH increases, it is possible to judge whether or not the increase occurs due to the presence of coarse grains or an amorphous structure in the case of 100% nanocrystals.

According to the present invention, magnetic inspection enables measurement every production lot (every magnetic inspection lot) how much of the proportion of coarse grains or amorphous structure in the internal structure of the material powder coexist(s) in 100% nanocrystals.

Referring again to FIG. 2, the production lot L1 having a mixing ratio judged to be within the permissible range by magnetic inspection is conveyed on the belt conveyor C2 as it is. When the mixing ratio deviates from the permissible range, the rejected production lot L2 judged to be out of the permissible range branches off to and is conveyed by a belt conveyor C3, and then removed from the production process of a permanent magnet of the present invention.

The raw material powder E of the removed rejected lot L2 can be melted again as it is and fed to the liquid quenching step, or can also be used in the step following the inspection step by mixing with the raw material powder E of a passed lot L1 to thereby decrease a mixed ratio of coarse grain or amorphous structure within the permissible range.

The coarse grain ratio (=mixed ratio of coarse grains to 100% nanocrystalline structure) is desirably 5% or less, and more desirably 2% or less, by volume %. Whereby, residual magnetization can be enhanced. Particularly, when intensive hot-working is carried out, it is possible to enhance the degree of orientation, leading to enhancement in residual magnetization. It is also possible to enhance coercivity since it is per se nanocrystal.

The amorphous structure ratio (=mixed ratio of amorphous structure to 100% nanocrystalline structure) is desirably 20% or less, and more desirably 5% or less, by volume %. Whereby, residual magnetization can be enhanced. Particularly, when intensive hot-working is carried out, it is possible to enhance the degree of orientation, leading to enhancement in residual magnetization. It is also possible to enhance coercivity since it is per se nanocrystal.

It is desirable that a given amount of each production lot L of the raw material powder E to be subjected to magnetic inspection, be accommodated in a non-magnetic container. A glass container, a plastic container, and the like are suited as the non-magnetic container. Since the amount of the raw material powder E to be subjected to inspection is proportional to the intensity of the transmitted magnetic field W2, it is desirable that the margin of error of the weight be within ±1% so as to enhance inspection precision of coarse grains or amorphous structure.

It is desirable that the position of each production lot L of the raw material powder E to be subjected to magnetic inspection be kept constant with respect to the transmitter T and the receiver R at the time of inspection. Regarding the change in position, the intensity of the transmitted magnetic field W1 to be applied to the lot L varies. If necessary, it is also possible to operate intermittently by stopping the belt conveyor C2 at the time of inspection.

EXAMPLES

Example 1

According to the present invention, permanent magnet samples were produced under the following conditions and procedures.

By a liquid quenching method, quenched flakes (several tens of μm in thickness, 1 to 2 mm in width, and 10 to 20 mm in length) with the composition of $Nd_{29.9}Pr_{0.4}Fe_{bal}Co_4B_{0.9}Ga_{0.5}$ (% by weight) were produced.

Figure 4:
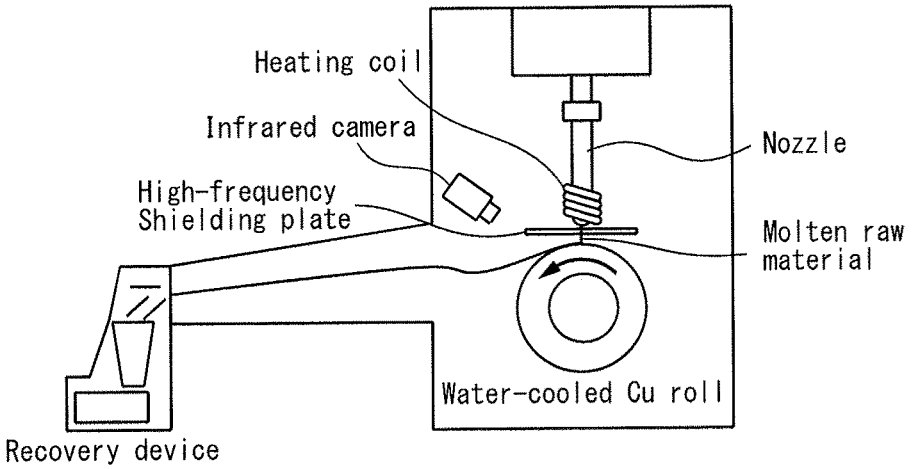
FIG. 4 schematically shows a liquid quenching apparatus.

A liquid quenching apparatus is schematically shown in FIG. 4.

Liquid quenching conditions are shown in Table 1. A preliminary test was carried out in advance to confirm that a structure composed of 100% nanocrystals is produced under this condition (roll peripheral speed: 20 m/s).

TABLE 1

| | |
|---|---|
| Nozzle material | Silicon nitride |
| Nozzle diameter | 0.6 mm |
| Clearance | L = 5 mm |
| Injection pressure | −40 kPa |
| Chamber internal pressure | −65 kPa |
| Roll peripheral speed | 20 m/s |
| Roll temperature | 10° C. |
| Melting temperature | 1,450° C. |

The quenched flake was pulverized by a roll mill to thereby adjust the length within a range of 200 to 300 μm.

The pulverized material powder was charged in a non-magnetic container made of glass and then a change in magnetic field was observed by passing the pulverized material powder through an alternating magnetic field having a magnetic field intensity of 20 mT.

The raw material powders thus obtained were integrated by sintering. The sintering was carried out under the conditions of a pressure of 400 MPa, a temperature of 620° C., and a retention time of 5 minutes.

The sintered body thus obtained was subjected to intensive hot-working by an upsetting press. The intensive hot-working was carried out under the conditions of a temperature of 780° C. and a strain rate of 8/s.

Comparative Example 1

Under the same conditions and procedures as in Example 1, except that the roll peripheral speed was decreased to 13 m/s, quenched flakes were produced.

Under this condition, a structure including nanocrystals and coarse grains coexisting therein was formed.

Under the same conditions and procedures as in Example 1, pulverization, magnetic inspection, sintering, and intensive hot-working were carried out.

Furthermore, the raw material powder composed of 100% nanocrystals prepared in Example 1 was mixed with the coarse grain-containing raw material powder prepared in Comparative Example 1 at various ratios to prepare mixed powders having various coarse grain ratios. Under the same conditions and procedures as in Example 1, pulverization, magnetic inspection, sintering, and intensive hot-working were carried out with respect to the mixed powders.

Evaluation of Relation Between Structure (Coarse Grain Ratio) and Magnetic Characteristics With respect to the respective samples produced in Example 1 and Comparative Example 1, a relation between the coarse grain ratio and the magnetic characteristics was examined.

Figure 5:
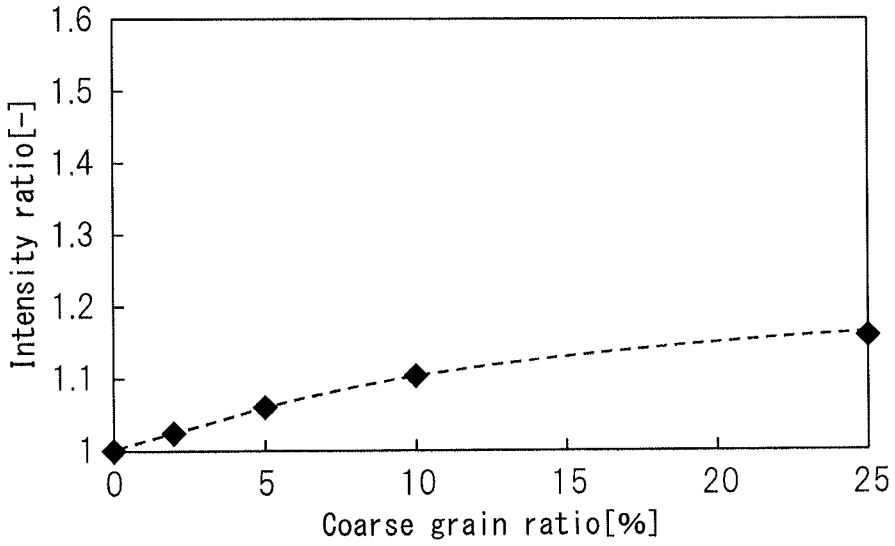
FIG. 5 shows a relation between a peak intensity ratio and a coarse grain ratio as magnetic characteristics.

A relation between a peak intensity ratio and a coarse grain ratio is shown in FIG. 5 as magnetic characteristics. The peak intensity ratio is obtained by the equation shown below. The coarse grain ratio was determined by structure observation using SEM.

Peak intensity ratio=[measured maximum peak intensity]/[maximum peak intensity at coarse grain ratio of 0%]

As mentioned above, a difference between a transmitted magnetic field W1 and a transmitted magnetic field W2 of an alternating magnetic field was detected as a peak, and a ratio of a maximum value thereof to a standard value was regarded as a peak intensity ratio. In other words, a maximum peak intensity inspected in 100% nanocrystals (=0% coarse grain) produced in Example 1 was regarded as a standard value, whereas, a ratio of a maximum peak intensity inspected at each coarse grain ratio produced in Comparative Example 1 was regarded as a peak intensity ratio (vertical axis "intensity ratio" of FIG. 5).

As is apparent from FIG. 5, the coarse grain ratio of 2% or more enables inspection (inspection sensitivity of 2%) by magnetic inspection.

Figure 6:
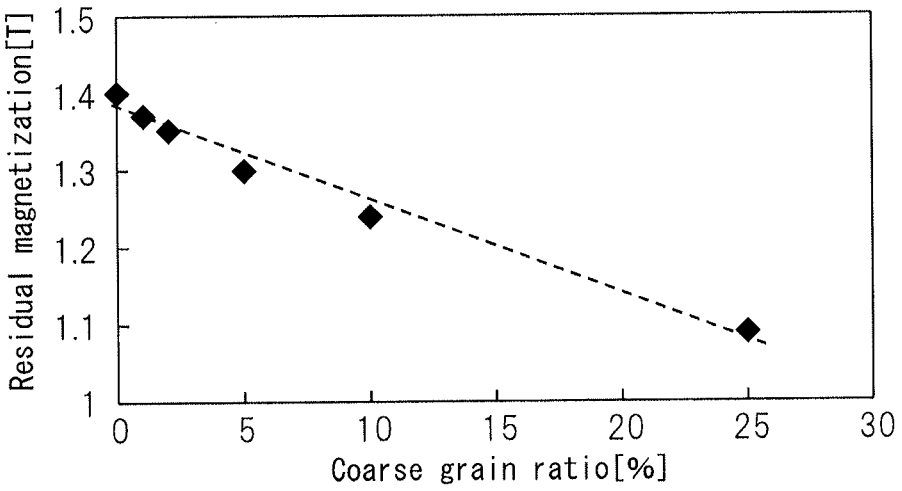
FIG. 6 shows a relation between a coarse grain ratio of a raw material powder and residual magnetization of a final sample after intensive hot-working.

A relation between a coarse grain ratio of a material powder and residual magnetization of a final sample after intensive hot-working is shown in FIG. 6. As shown in the drawing, the residual magnetization reduced with the increase of the coarse grain ratio. This is because coarse grains contained in the material powder are not oriented by intensive hot-working.

Figure 7:
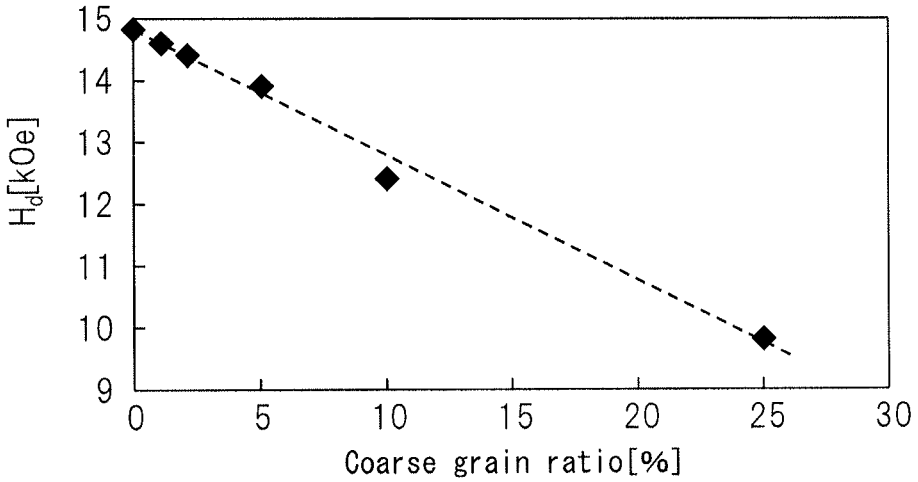
FIG. 7 shows a relation between a coarse grain ratio of a raw material powder and a magnetic field at which demagnetization of a final sample starts (demagnetizing field) Hd.

A relation between a coarse grain ratio of a material powder and a magnetic field at which demagnetization of a final sample starts (demagnetizing field) Hd is shown in FIG. 7. The demagnetizing field Hd is a magnetic field of a kink (shoulder) at which a demagnetization curve quickly going downward from a linear section, and is a characteristic corresponding to the coercivity Hc and also has larger variation due to change in structure than that due to change in coercivity Hc. Like the residual magnetization, the demagnetizing field Hd also reduced with the increase of the coarse grain ratio.

The results of FIGS. 6 and 7 revealed that the coarse grain ratio of the material powder is desirably 5% or less, and more desirably 2% or less, so as to achieve high residual magnetization and coercivity.

As is apparent from FIG. 5, the coarse grain ratio of the material powder is 5% or less if the peak intensity ratio determined is 1.06 or less in magnetic inspection, and the coarse grain ratio of the material powder is 2% or less if the peak intensity ratio is 1.02 or less in magnetic inspection.

Accordingly, using the relation of FIG. 5 as a calibration curve without directly observing the internal structure, it is possible that an internal structure of a material powder is indirectly judged by magnetic inspection, which can be easily applied to the industrial production process, and only an accepted lot having few coarse grains is selected as a raw material powder and subjected to sintering and intense hot-working to produce a permanent magnet having excellent residual magnetization and coericivity.

Comparative Example 2

Under the same conditions and procedures as in Example 1, except that the roll peripheral speed was decreased to 30 m/s, quenched flakes were produced. A preliminary test was carried out in advance to confirm that a structure composed of a 100% amorphous structure is produced under this condition (roll peripheral speed: 30 m/s).

Under the same conditions and procedures as in Example 1, pulverization, magnetic inspection, sintering, and intensive hot-working were carried out.

Furthermore, the raw material powder composed of 100% nanocrystals prepared in Example 1 was mixed with the raw material powder composed of a 100% amorphous structured prepared in Comparative Example 2 at various ratios to prepare mixed powders having various amorphous structure ratios. Under the same conditions and procedures as in Example 1, pulverization, magnetic inspection, sintering, and intensive hot-working were carried out with respect to the mixed powders.

Evaluation of Relation Between Structure (Amorphous Structure Ratio) and Magnetic Characteristics With respect to the respective samples produced in Example 1 and Comparative Example 2, a relation between the amorphous structure ratio and the magnetic characteristics was examined.

Figure 8:
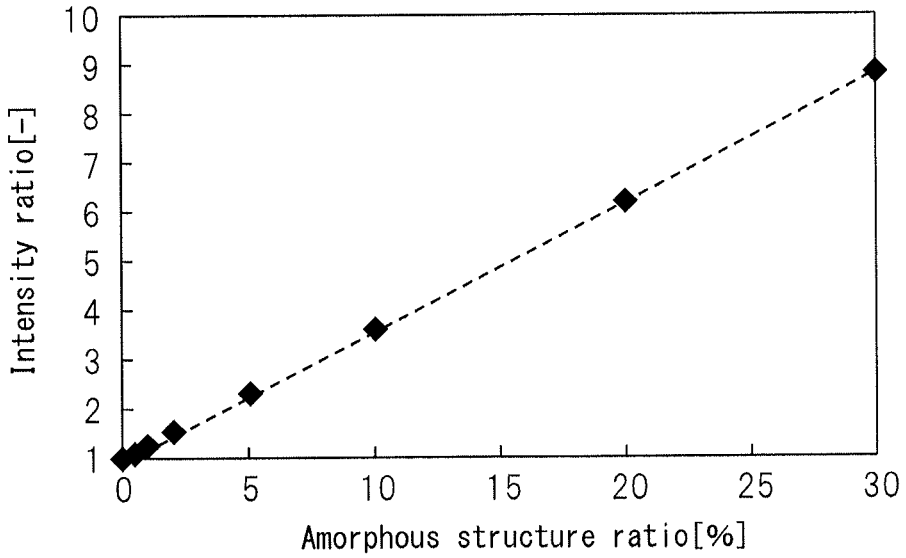
FIG. 8 shows a relation between a peak intensity ratio and a coarse grain ratio as magnetic characteristics.

A relation between a peak intensity ratio and an amorphous structure ratio is shown in FIG. 8 as magnetic characteristics. The peak intensity ratio is obtained by the equation shown below. The amorphous structure ratio was determined by structure observation using SEM.

Peak intensity ratio=[measured maximum peak intensity]/[maximum peak intensity at amorphous ratio of 0%]

As mentioned above, a difference between a transmitted magnetic field W1 and a transmitted magnetic field W2 of an alternating magnetic field was detected as a peak, and a ratio of a maximum value thereof to a standard value was regarded as a peak intensity ratio. In other words, a maximum peak intensity inspected in 100% nanocrystals (=0% coarse grain) produced in Example 1 was regarded as a standard value, whereas, a ratio of a maximum peak intensity inspected for each amorphous structure ratio produced in Comparative Example 1 was regarded as a peak intensity ratio (vertical axis "intensity ratio" of FIG. 8).

As is apparent from FIG. 8, an amorphous structure ratio of 0.5% or more enables inspection (inspection sensitivity of 0.5%) by magnetic inspection.

Figure 9:
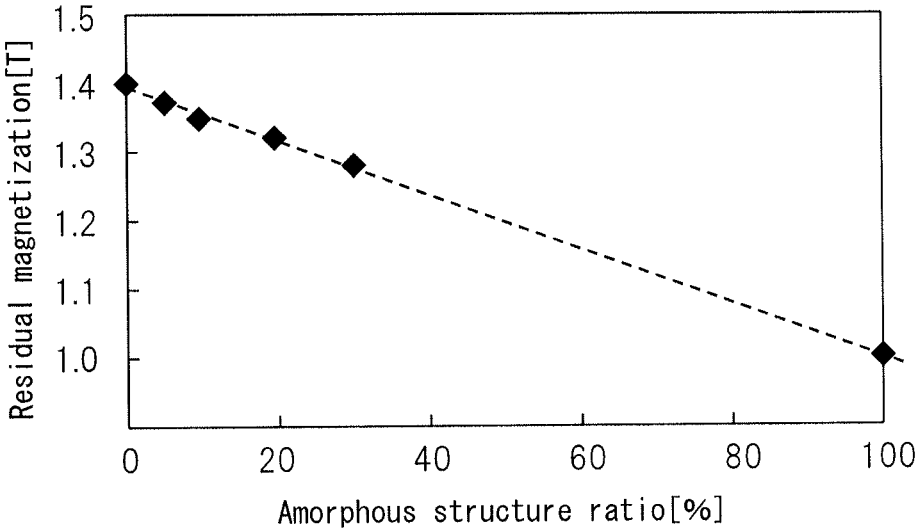
FIG. 9 shows a relation between an amorphous structure ratio of a raw material powder and residual magnetization of a final sample after intensive hot-working.

A relation between an amorphous structure ratio of a raw material powder and residual magnetization of a final sample after intensive hot-working is shown in FIG. 9. As shown in the drawing, the residual magnetization decreased with the increase of the amorphous structure ratio. This is because the amorphous structure contained in the raw material powder is converted into crystal grains having a shape which is less likely to orient when crystallized by heating during intensive hot-working.

The results of FIG. 9 revealed that the amorphous structure ratio of the raw material powder is desirably 20% or less, and more desirably 5% or less, so as to achieve high residual magnetization.

As is apparent from FIG. 8, the amorphous structure ratio of the raw material powder is 20% or less if the peak intensity ratio determined is 6.2 or less in magnetic inspection, and the amorphous ratio of the raw material powder is 5% or less if the peak intensity ratio is 2.3 or less in magnetic inspection.

Accordingly, the internal structure of a material powder is indirectly judged by magnetic inspection, which can be easily applied to an industrial production process, without directly observing the internal structure using the relation of FIG. 8 as a calibration curve, and then only a lot which has passed with less amorphous structure as a raw material powder is selectively sintered and subjected to intensive hot-working, thus enabling the production of a permanent magnet having excellent residual magnetization and coercivity.

A detailed description was made of the case where a raw material powder is integrated by sintering and then subjected to intensive hot working. However, there is no need to limit the method for producing a permanent magnet of the present invention to the above case. For example, it is possible to use the magnet in a powdered state. Typically, it is also possible to apply the method to cases where the raw material powder judged as good is integrated with a rubber or a plastic by embedding therein to produce a bonded magnet. Even if the raw material powder is integrated by any other methods, a permanent magnet having high residual magnetization and coercivity is obtained when using a raw material powder judged as good by the present invention.

INDUSTRIAL APPLICABILITY

According to the present invention, there are provided a method for producing a raw material powder for the production of a permanent magnet having high residual magnetization and coercivity by quickly inspecting the propriety of the structure of a material powder in actual industrial production; a method for producing a permanent magnet; and a method for inspecting magnetic characteristics of a permanent magnet raw material powder.

The invention claimed is:

1. A method for selecting a raw material powder of a permanent magnet from a material powder of the permanent magnet, which comprises the steps of:

preparing a material powder of a permanent magnet;

measuring magnetic characteristics of the material powder of the permanent magnet, including:

transmitting a magnetic field between −30 kOe to 30 kOe through the material powder, receiving the magnetic field from the material powder, and measuring a magnetic field difference between the transmitted magnetic field and the received magnetic field as the magnetic characteristics;

determining a magnetization gradient dM/dH based on the measured magnetic characteristics of the material powder, the magnetization gradient dM/dH being defined as a gradient of a rising section of a magnetization curve to which the magnetic field is applied;

judging a quality of the material powder as the raw material powder by: (i) comparing the determined magnetization gradient dM/dH to a predetermined baseline indicative of a concentration of each of amorphous structure, coarse grains and nanocrystals, and (ii) identifying a composition of the raw material powder; and selecting the material powder based on whether the identified composition of the raw material powder satisfies a predetermined amount of amorphous structure, coarse grains or nanocrystals.

2. The method for selecting the raw material powder of the permanent magnet according to claim 1, wherein an alternating magnetic field is applied as the magnetic field.

3. The method for selecting the raw material powder of the permanent magnet according to claim 1, wherein the material powder is obtained by a liquid quenching method.

4. The method for selecting the raw material powder of the permanent magnet according to claim 2, wherein the material powder is obtained by a liquid quenching method.

5. The method for selecting the raw material powder of the permanent magnet according to claim 3, wherein a quenched flake as the material powder has a length of 50 μm to 1,000 μm.

6. A method for producing a permanent magnet, the method comprising the steps of:

preparing a material powder of a permanent magnet;

measuring magnetic characteristics of the material powder of the permanent magnet, including:

transmitting a magnetic field between −30 kOe to 30 kOe through the material powder, receiving the magnetic field from the material powder, and measuring a magnetic field difference between the transmitted magnetic field and the received magnetic field as the magnetic characteristics;

determining a magnetization gradient dM/dH based on the measured magnetic characteristics of the material powder, the magnetization gradient dM/dH being defined as a gradient of a rising section of a magnetization curve to which the magnetic field is applied;

judging a quality of the material powder as the raw material powder by: (i) comparing the determined magnetization gradient dM/dH to a predetermined baseline indicative of a concentration of each of amorphous structure, coarse grains and nanocrystals, and (ii) identifying a composition of the raw material powder;

selecting the material powder based on whether the identified composition of the raw material powder satisfies a predetermined amount of amorphous structure, coarse grains or nanocrystals; and integrating the selected material powder to produce the permanent magnet.

7. A method for producing a permanent magnet, which comprises the step of integrating raw material powders selected in the step of selecting the raw material powder by the method according to claim 2.

8. A method for producing a permanent magnet, which comprises the step of integrating raw material powders selected in the step of selecting the raw material powder by the method according to claim 3.

9. A method for producing a permanent magnet, which comprises the step of integrating raw material powders selected in the step of selecting the raw material powder by the method according to claim 4.

10. A method for producing a permanent magnet, which comprises the step of integrating raw material powders selected in the step of selecting the raw material powder by the method according to claim 5.

11. The method for producing the permanent magnet according to claim 6, wherein the selected raw material powders are integrated by sintering and then subjected to intensive hot-working.

12. The method for producing the permanent magnet according to claim 7, wherein the selected raw material powders are integrated by sintering and then subjected to intensive hot-working.

13. The method for producing the permanent magnet according to claim 8, wherein the selected raw material powders are integrated by sintering and then subjected to intensive hot-working.

14. The method for producing the permanent magnet according to claim 9, wherein the selected raw material powders are integrated as by sintering and then subjected to intensive hot-working.

15. The method for producing the permanent magnet according to claim 10, wherein the selected raw material powders are integrated by sintering and then subjected to intensive hot-working.

16. The method for selecting the raw material powder of the permanent magnet according to claim 4, wherein a quenched flake as the material powder has a length of 50 μm to 1,000 μm.

17. A method for producing a permanent magnet, which comprises the step of integrating raw material powders selected in the step of selecting the raw material powder by the method according to claim 16.

18. The method for producing the permanent magnet according to claim 17, wherein the selected raw material powders are integrated by sintering and then subjected to intensive hot-working.

19. The method for selecting the raw material powder of the permanent magnet according to claim 1, wherein the predetermined amount of coarse grains is a coarse grain ratio of 5% or less.

20. The method for selecting the raw material powder of the permanent magnet according to claim 1, wherein the predetermined amount of coarse grains is a coarse grain ratio of 2% or less.

21. The method for selecting the raw material powder of the permanent magnet according to claim 1, wherein the predetermined amount of amorphous structure is an amorphous structure ratio of 20% or less.

22. The method for selecting the raw material powder of the permanent magnet according to claim 1, wherein the predetermined amount of amorphous structure is an amorphous structure ratio of 5% or less.

* * * * *